United States Patent [19]

Werner

[11] Patent Number: 4,572,050

[45] Date of Patent: Feb. 25, 1986

[54] NO STRAP SAXOPHONE STAND

[76] Inventor: Milton M. Werner, 6703 NW. 71st Ct., Tamarac, Fla. 33319

[21] Appl. No.: 553,554

[22] Filed: Nov. 21, 1983

[51] Int. Cl.[4] ..... G10G 5/00

[52] U.S. Cl. ..... 84/385 A; 84/453

[58] Field of Search ..... 84/385, 453, 327

[56] References Cited

U.S. PATENT DOCUMENTS

| | | | |
|---|---|---|---|
| 1,464,279 | 8/1923 | Hindley | 84/385 B |
| 1,900,718 | 3/1933 | Lang | 84/385 A |
| 2,262,556 | 11/1941 | Richmond | 84/385 B |
| 4,176,580 | 12/1979 | Gallegos | 84/327 |

*Primary Examiner*—Lawrence R. Franklin

*Attorney, Agent, or Firm*—Robert M. Schwartz; Edward I. Mates

[57] ABSTRACT

A saxophone stand for releasably supporting a musical instrument, having a base, an elongated support member mounted and balanced on the base, further having a bell rest for receiving the bell of the saxophone and a lower brace for supporting the lower portion of the saxophone, forces created by the bell rest and lower brace acting against the saxophone hold the saxophone in a balanced position in order that the instrument can be played without using a supporting strap around the player's neck.

6 Claims, 9 Drawing Figures

NO STRAP SAXOPHONE STAND

BACKGROUND OF THE INVENTION

1. Field of the Invention

The present invention relates to an apparatus for supporting a tenor or alto saxophone without the use of a saxophone strap around the neck to hold the instrument.

2. Description of the Prior Art

It is well known by musicians of the discomfort of the saxophone strap around the neck to support the instrument playing on the job or sustained during private practice.

Numerous inventions have attempted to provide a means to support the heavy weight of the saxophone. However, these inventions limited either the portability of the instrument in that it is not easily detached from the stand or in that the instrument is not supported while playing.

A typical musical instrument support is documented by U.S. Pat. No. 3,266,766 issued to T.V. Linville, Jr., on Aug. 16, 1966. Though Linville solves the problem of supporting the instrument, it is not free to be detached easily from the stand.

Other patents describing the closest subject matter provide for a number of more or less complicated features that fail to solve the problem in an efficient and economical way. None of these patents suggest the novel features of the present invention.

SUMMARY OF THE INVENTION

It is the main object of this invention to play a saxophone in a sitting position, without the use of a saxophone strap around the neck to support the instrument.

Another object is to remove the weight and pressure from the left and right carotid arteries on the sides of the neck.

A further object is that the saxophone once placed in playing position, remains the same when the musician sits down to perform.

A still further object is that the saxophone stand supports all the weight of the instrument resulting in more freedom in breathing and endurance for the saxophonist.

Still another object is to provide such saxophone stand with improvements in materials for balance and holding.

Another object is the decorative possibilities of the wood base that supports the saxophone stand.

A further object is that the saxophone be easily removed from the stand.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
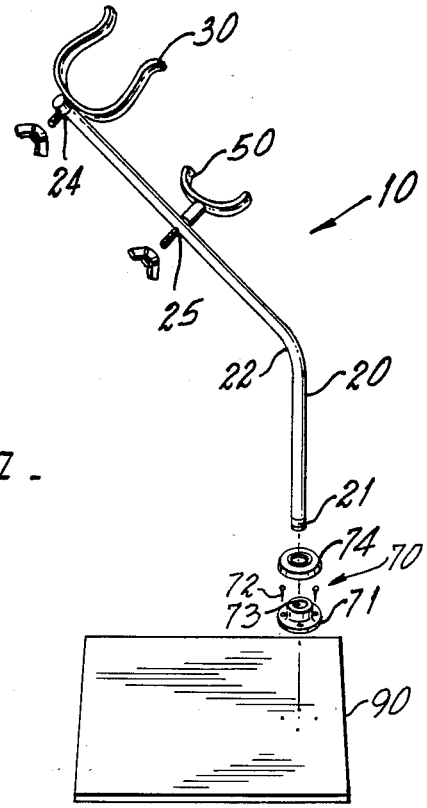
FIG. 1 is a perspective view of said saxophone stand.
Figure 2:
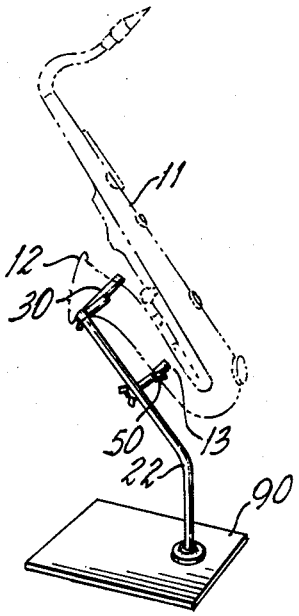
FIG. 2 is a perspective view of said saxophone stand showing a tenor saxophone mounted thereon.
Figure 3:
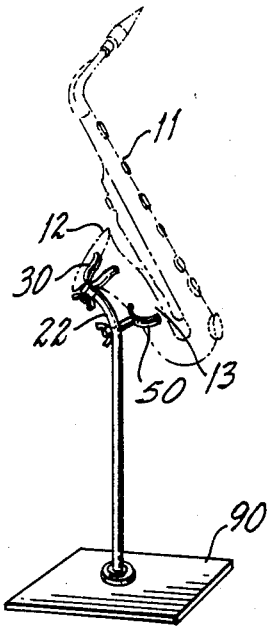
FIG. 3 is a perspective view of said saxophone stand showing an alto saxophone mounted thereon.

Referring now to FIG. 1, wherein the no strap saxophone stand is referred to generally with numeral 10, it can be seen that it comprises a round tube 20, a bell rest 30, a lower brace 50, a flange assembly 70 and a base 90 in the preferred embodiment. A saxophone 11 having a bell 12 and a base 13 is held in place by base 13 resting on lower brace 50 as shown in FIGS. 2 and 3.

An elongated member in the form of a round tube 20 is securely attached to base 90 by means of flange assembly 70. The latter comprises a flange 71 secured by screws 72 or by adhesive means to base 90. Flange 71 includes an internal screw 73 for receiving an external screw 21 of round tube 20. A decorative flange 74 provides a decorative cover for flange assembly 70. As will be seen later, flange assembly 70 is precisely located on base 90 to accomplish a perfect balance for saxophone 11.

Base 90 is wood or other suitable material and rests flatly on the floor or other surface. In the preferred embodiment, base 90 is of a size in order that it can cooperate with and be positioned close to a four legged chair in order that the instrument can be played in a sitting position. It is also possible to play the instrument in a standing position by placing the base on a higher level, such as the chair the player sits on.

Figure 9:
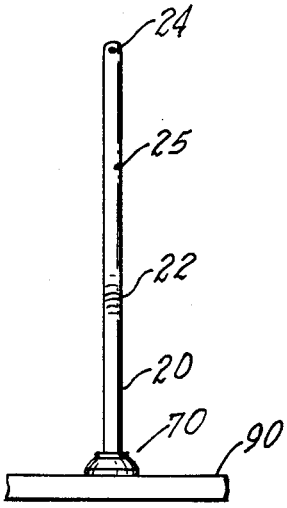
FIG. 9 is a back perspective view of said saxophone stand showing the round tube.

Round tube 20 is cut to a desired length depending upon the type of instrument to be supported. Along the length of round tube 20 is a bend 22 and attached to said round tube 20 is bell rest 30 at an upper hole 24 and lower brace 50 at a lower hole 25. As shown in FIG. 9, upper hole 24 is orientated directly on the vertical axis of round tube 20. The center axis of lower hole 25 is off center of the vertical axis of round tube 20. Top of tube 20 is protected with a cap (not shown) to prevent damage to the underside lip of bell 12.

Figure 4:
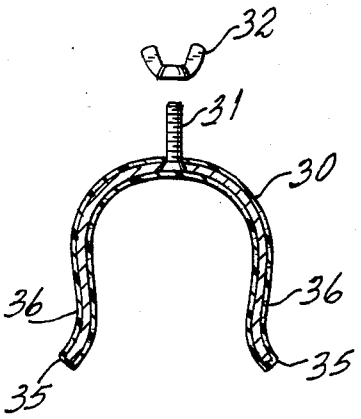
FIG. 4 is a plan view of the bell rest.

Bell rest 30 (FIG. 4) is in a "U" shape for substantially conforming to and for gripping the bell 12 of saxophone 11. Said bell rest 30 has a center screw 31 and wing nut 32 for attachment to round tube 20 at upper hole 24. Ends 35 of bell rest 30 turn outward in order to facilitate the placing of the instrument bell 12 in said bell rest 30. Bell rest 30 is constructed of a resilient vinyl material that firmly grips bell 12. Bell rest 30 exerts pressure and grips said bell 12 where indicated by points 36.

Figure 5:
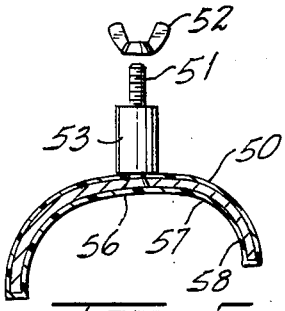
FIG. 5 is a plan view of the lower brace.
Figure 6:
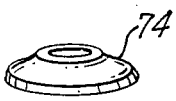
FIG. 6 is a perspective view of the decorative flange.
Figure 7:
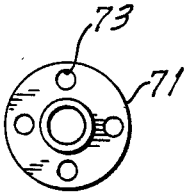
FIG. 7 is a plan view of the flange.

Lower brace 50 (FIG. 5) is substantially a "U" shape providing an area for the lower base 13 of saxophone 11 to rest. Lower brace 50 includes a screw 51 and a wing nut 52 for attachment to round tube 20 at lower hole 25. As previously noted lower hole 25 is located to the right of center in relation to upper hole 24. This causes the center of gravity at the lower portion of the saxophone to create a moment of force about a fulcrum located at the bell rest 30 acting in a clockwise direction toward lower brace 50. This moment of force rigidly holds the saxophone in place against lower brace 50. In addition, this causes the saxophone to rest in an exact position when being played, as if the player were using a strap. A sleeve 53 spaces lower brace 50 away from round tube 20. In the preferred embodiment lower base 50 is covered with a vinyl plastic material to prevent damage to saxophone 11 and providing gripping characteristics to prevent the saxophone 11 from slipping.

Figure 8:
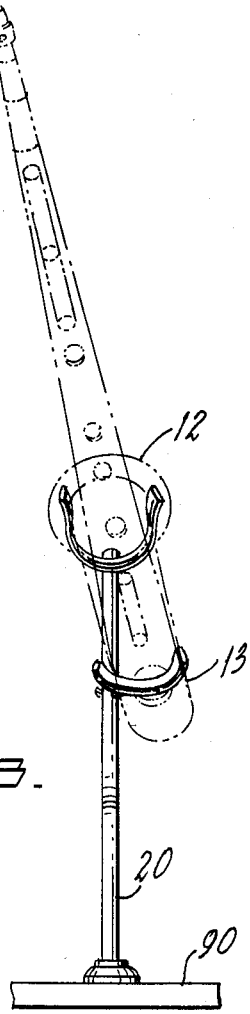
FIG. 8 is a back perspective view of said saxophone stand showing a tenor saxophone mounted thereon.

In use the saxophone 11 is placed on the no strap saxophone stand 10 as follows: saxophone bell 12 is placed onto bell rest 30, the saxophone is then carefully pressed downward such that the bell 12 slides as much as possible with the widening position of the saxophone bell 12 forming a sliding support therewith until the saxophone base 13 rests against lower brace 50. The design and placement of the bell rest 30 will cause the top of saxophone 11 to lean to the players left which is a comfortable position for playing, as shown in FIG. 8. The saxophone is held in perfect balance by means of a moment of force created about a fulcrum that results when the widening portion of bell 12 rests on bell rest 30 forcing the saxophone base 13 against short portion 58 of lower base 50. Still, the saxophone has excellent mobility. The grip of bell rest 30 can be adjusted without the saxophone by slightly squeezing the ends together for a tighter grip or vice versa for less tension on the saxophone bell 12. More correction of the saxophone to the left can easily be obtained by gripping the bottom of the saxophone with the user's right hand, holding the saxophone at the top in place with the user's left hand and slowly turning the right hand grip to the left. Furthermore the saxophone and or the neck of the saxophone can be turned slightly to the left or right.

As can be seen, the use of a tenor saxophone or the alto saxophone is merely a matter of design, adjusting for the center of gravity and a perfect balance as shown by comparing FIG. 2 tenor sax with FIG. 3 alto sax, bend 22 is located higher on round tube 20 with a corresponding changes for the position of bell rest 30 and that of lower brace 50 along the length of the tube 20 when the stand is used for an alto saxophone.

It is believed the foregoing description conveys the best understanding of the objects and advantages of the present invention. Different embodiments may be made of the inventive concept of this invention. It is to be understood that all matter disclosed herein is to be interpreted merely as illustrative, and not in limiting sense, except as set forth in the following appended claims.

What is claimed is:

1. Apparatus for supporting a musical instrument having a bell so that said instrument is positioned for playing without needing a strap for a player of said instrument, said apparatus comprising (a) flexible support means of essentially U-shaped configuration for engaging said bell where said bell is widening to provide fulcrum support means for said instrument at said widening portion to one side of the center of gravity of said instrument;

(b) additional support means of essentially U-shaped configuration offset vertically from said flexible support means and offset horizontally from said flexible support means in the same direction as said center of gravity to support said instrument thereagainst in such a position that said instrument has its mouthpiece in a position convenient for playing; and (c) means for supporting said flexible support means and said additional support means in said offset relation to provide said convenient position for said mouthpiece, the essentially U-shaped configuration of said flexible support means and of said additional support means allowing said instrument to be mounted on said apparatus in said convenient position or removed from said apparatus without requiring disassembly of said apparatus.

2. Apparatus as in claim 1, wherein said support means comprises a base and an elongated support member mounted on said base, said elongated support member having an obliquely extending portion supporting said flexible support means above and to one side of said additional support means.

3. Apparatus as in claim 2, wherein said elongated support member has a lower vertically extending portion fixed to said base and an obliquely extending portion extending upwardly from said lower vertically extending portion.

4. Apparatus as in claim 3, further including means to clamp said flexible support means to said elongated support member, means to clamp said additional support means to said elongated support member, and means to adjust the position of at least one of said clamping means along the length of said elongated support member.

5. Apparatus as in claim 4, further including means to adjust the position of the other of said clamping means along the length of said elongated support member.

6. Apparatus as in claim 1, wherein said flexible support means and said additional support means are provided with instrument engaging surfaces of a material that does not harm the surface of said instrument.

* * * * *